US009382888B2

(12) United States Patent
Werger

(10) Patent No.: US 9,382,888 B2
(45) Date of Patent: Jul. 5, 2016

(54) INJECTION NOZZLE FOR INJECTING MEDIA INTO A COMBUSTION CHAMBER

(71) Applicant: Robert Bosch GmbH, Stuttgart (DE)

(72) Inventor: Heinrich Werger, Kuchl (AT)

(73) Assignee: Robert Bosch GmbH, Stuttgart (DE)

( * ) Notice: Subject to any disclaimer, the term of this patent is extended or adjusted under 35 U.S.C. 154(b) by 110 days.

(21) Appl. No.: 14/386,849

(22) PCT Filed: Mar. 28, 2013

(86) PCT No.: PCT/EP2013/056770
§ 371 (c)(1),
(2) Date: Sep. 22, 2014

(87) PCT Pub. No.: WO2013/149954
PCT Pub. Date: Oct. 10, 2013

(65) Prior Publication Data

US 2015/0034051 A1 Feb. 5, 2015

(30) Foreign Application Priority Data

Apr. 5, 2012 (AT) ..... 413/2012

(51) Int. Cl.
*F02M 53/04* (2006.01)
*F02M 61/14* (2006.01)

(52) U.S. Cl.
CPC ..... *F02M 61/14* (2013.01); *F02M 53/04* (2013.01); *F02M 2700/077* (2013.01)

(58) Field of Classification Search
CPC ..... F02M 61/14; F02M 53/046; F02M 53/04; F02M 53/00; F02M 53/043; F02M 61/10; F02M 61/16; F02M 61/167; F02M 2200/25; F02M 2200/85
See application file for complete search history.

(56) References Cited

U.S. PATENT DOCUMENTS 2,887,994 A * 5/1959 Morris ..... F01P 1/10 123/276
5,494,220 A * 2/1996 Shinogle ..... F02M 57/02 239/88
6,119,658 A * 9/2000 Jehle ..... F02M 61/14 123/41.31

FOREIGN PATENT DOCUMENTS

DE 974 647 3/1961
DE 197 43 103 A1 4/1999
FR 848.063 10/1939
JP H 10-252610 A 1/1997

OTHER PUBLICATIONS

International Search Report corresponding to PCT Application No. PCT/EP2013/056770, mailed Jul. 17, 2013 (German and English language document) (5 pages).

* cited by examiner

*Primary Examiner* — Lindsay Low
*Assistant Examiner* — Jacob Amick
(74) *Attorney, Agent, or Firm* — Maginot, Moore & Beck LLP

(57) ABSTRACT

An injection nozzle for injecting media into a combustion chamber includes a nozzle body having a tip with spray holes and protruding into the combustion chamber, and a heat protection sleeve that surrounds and is positioned on a combustion chamber side of an end area of the nozzle body. The injection nozzle is inserted into an accommodating hole of a retaining part, whereby the end area of the nozzle body interacts with the accommodating hole, and whereby the sleeve is positioned there-between. The sleeve further has a first and second area which are located at an axial distance from each other and which have respective sealing surfaces that interact in a sealing manner with either (i) an annular seat surface extending in a radial plane, or (ii) a cone-shaped seat surface of the accommodating hole or of the nozzle body.

13 Claims, 3 Drawing Sheets

INJECTION NOZZLE FOR INJECTING MEDIA INTO A COMBUSTION CHAMBER

This application is a 35 U.S.C. §371 National Stage Application of PCT/EP2013/056770, filed on Mar. 28, 2013, which claims the benefit of priority to Serial No. AT 413/2012, filed on Apr. 5, 2012 in Austria, the disclosures of which are incorporated herein by reference in their entirety.

The disclosure relates to an injection nozzle for injecting media into a combustion chamber, in particular fuel into the combustion chamber of an internal combustion engine, comprising a nozzle body whose nozzle tip, which has the spray holes, projects into the combustion chamber, and comprising a heat protection sleeve which is arranged in the combustion chamber-side end region of the nozzle body and which surrounds the nozzle body, wherein the injection nozzle is inserted into a receiving bore of a holding part, in particular cylinder head, wherein the combustion chamber-side end region of the nozzle body interacts with the receiving bore via the heat protection sleeve.

BACKGROUND

Sleeves which surround the nozzle bodies of fuel injection nozzles, in particular gasoline direct injection valves or diesel direct injection valves, are already known. They have the task of surrounding the nozzle body in the form of a cooling jacket. They furthermore also act as fastening means for fixing the injection nozzle in the holding part, in particular in the cylinder head. For example, DE 19743103 A1 discloses a heat protection sleeve which is inserted into a stepped receiving bore of a cylinder head of an internal combustion engine and which circumferentially surrounds a discharge-side nozzle body of a fuel injection valve that is inserted into the receiving bore.

Heat protection sleeves are however used not only with injection nozzles for internal combustion engines but also in different injection systems in other sectors, for example in the chemical industry. The heat protection sleeve is normally composed of copper or NiRo and covers the injection nozzle at the nozzle dome so as to prevent introduction of heat. Furthermore, the heat protection sleeve encases the injection nozzles along the nozzle shank in order to transport the temperature along the sleeves away from the nozzle tip to a cooled region of the installation space, for example of the cylinder head. The heat protection sleeve is in some cases formed integrally with the water sleeve that separates the cooling ducts formed in the cylinder head from the injector installation space.

A disadvantage of the conventional designs is that they require a relatively large passage bore in the holding part because the passage bore has to accommodate not only the nozzle body but additionally also the heat protection sleeve that encases the nozzle body. The relatively large passage bore in turn results in a relatively large force that is exerted on the injection nozzle from the combustion chamber side by the combustion chamber pressure, because said force increases with the square of the diameter of the bore. To reduce the surface area exposed to the combustion chamber pressure, the injection nozzle may, at its tip, be formed with a bevel via which it lies against the holding part with the interposition of a sealing disk or the heat protection sleeve. This however has the disadvantage that the clamping force with which the injection nozzle is clamped into the holding part is introduced at a relatively small diameter, which leads to disadvantageously high local stresses and intense deformations of the injection nozzle and/or of the holding part.

SUMMARY

It is thus the object to further develop an injection nozzle of the type mentioned in the introduction such that the nozzle body surface area exposed to the combustion chamber pressure and combustion chamber heat is minimized, and the heat protection sleeve simultaneously ensures adequate sealing with respect to the combustion chamber pressure. Furthermore, the clamping force with which the injection nozzle is clamped into the holding part should not lead to local stresses that lead to deformations of the injection nozzle or of the holding part.

To achieve said object, the disclosure provides that the heat protection sleeve has a first region and a second region which are axially spaced apart from one another, wherein the second region is arranged closer than the first region to the nozzle tip, wherein, in the first region, a first external circumferential sealing surface is formed on the outer face and a first internal circumferential sealing surface is formed on the inner face, and in the second region, a second external circumferential sealing surface is formed on the outer face and a second internal circumferential sealing surface is formed on the inner face, wherein the second sealing surfaces are situated at a smaller diameter than the first sealing surfaces, wherein the first external sealing surface and the second external sealing surface interact in each case in sealing fashion with an annular seat surface running in a radial plane or with a conical seat surface of the receiving bore, and the first internal sealing surface and the second internal sealing surface interact in each case in sealing fashion with an annular seat surface running in a radial plane or with a conical seat surface of the nozzle body. The disclosure thus relates to designing a heat protection sleeve such that it lies, preferably in the manner of a double fit, both against the nozzle tip and also against a sealing point, situated thereabove, on the cylinder head, wherein the heat protection sleeve lies against the nozzle tip at a smaller diameter than that at which it lies against the sealing point situated thereabove, such that installation from the side facing away from the combustion chamber is made possible. At the same time, this results in the nozzle having a very small surface area exposed to the combustion chamber heat, and in sealing with respect to the combustion chamber pressure being performed over a very small surface area, whereby the "blow by" tendency, that is to say the risk of combustion chamber pressure escaping between the injection nozzle and cylinder head, is reduced considerably. A further advantage lies in the fact that, during the assembly process, there is generated at the nozzle tip a contact pressure that is adequate for sealing with respect to the combustion chamber pressure, wherein the remaining clamping force of the injector clamping means is accommodated at the sealing point situated thereabove. The clamping force with which the injection nozzle is clamped in the cylinder head is thus introduced at least partially at a relatively large diameter, specifically at the sealing point situated further above, such that the stresses and deformations generated in the nozzle body and in the cylinder head can be reduced.

The first sealing surfaces and the second sealing surfaces preferably form a double fit, whereby particularly effective fixing of the injection nozzle at two regions defined by the double fit is achieved.

Since it is generally the case that, during the insertion of the heat protection sleeve, a deformation of the heat protection sleeve occurs for the purposes of compensating component tolerances, it is provided in a preferred refinement that the heat protection sleeve is under preload when the injection nozzle is in the inserted state in the holding part. This may be reduced by virtue of the heat protection sleeve preferably being composed of a deformable material, such that, during the assembly process, the sealing surfaces are pressed against the seat surfaces such that the second sealing surfaces interact with the seat surfaces so as to generate a contact pressure, and such that the remaining clamping force of the nozzle clamping means is accommodated at the first sealing surfaces and the corresponding seat surfaces, whereby the heat protection sleeve can be produced in a more expedient manner with regard to production outlay and corresponding costs, and the exact fit is attained only during the insertion process as a result of deformation of the selected material.

If, as in a preferred embodiment of the present disclosure, at least one of the seat surfaces provided in the receiving bore is formed on a step of the receiving bore, that is to say the receiving bore has a shoulder that projects from the axial direction of the bore, the axial component of the combustion chamber pressure is kept away from the injection nozzle, and the "blow by" tendency is further reduced.

It is preferable for at least one of the seat surfaces provided on the nozzle body to be formed on the nozzle clamping nut.

In a further preferred embodiment of the present disclosure, the second sealing surfaces are formed on the combustion chamber-side end of the heat protection sleeve, such that the surface area exposed to the combustion chamber is further minimized. Here, the interaction of the second sealing surfaces with the seat surfaces preferably produces the combustion chamber-side seal of the nozzle body in the receiving bore.

To ensure the contact pressure at the first and second sealing surfaces in order to realize the stated double fit, the disclosure is preferably refined to the effect that the heat protection sleeve, in an axial section between the first sealing surfaces and the second sealing surfaces, is arranged with a radial spacing to the nozzle body and to the wall of the receiving bore.

To direct the heat prevailing in the combustion chamber away from the nozzle tip in as efficient a manner as possible, the disclosure is preferably refined to the effect that the heat protection sleeve is composed of a material with high thermal conductivity, in particular a thermal conductivity of greater than 100 W/(m·K), in particular of copper or a copper alloy.

In some cases, additional cooling is realized in the cylinder head by virtue of cooling water being conducted in a duct in the cylinder head in the region of the nozzle body, wherein said duct, in the prior art, is delimited by a water sleeve. In a preferred embodiment of the present disclosure, it is therefore provided that the heat protection sleeve is formed integrally with a water sleeve which surrounds the nozzle body and which delimits a cooling duct, which is arranged in the holding part, with respect to the nozzle body.

A particularly good sealing action is attained if, as in a preferred embodiment of the present disclosure, the second sealing surfaces have at least one projecting circumferential edge, in particular biting edges.

A further improvement of the sealing action under the influence of the combustion chamber pressure is achieved if, as in a preferred embodiment of the present disclosure, the heat protection sleeve has, between the internal and external second sealing surfaces, a circumferentially running groove or slot which is open toward the combustion chamber-side end.

BRIEF DESCRIPTION OF THE DRAWINGS

The disclosure will be explained in more detail below on the basis of an exemplary embodiment that is schematically illustrated in the drawing.

In the drawings.

DETAILED DESCRIPTION

Figure 1:
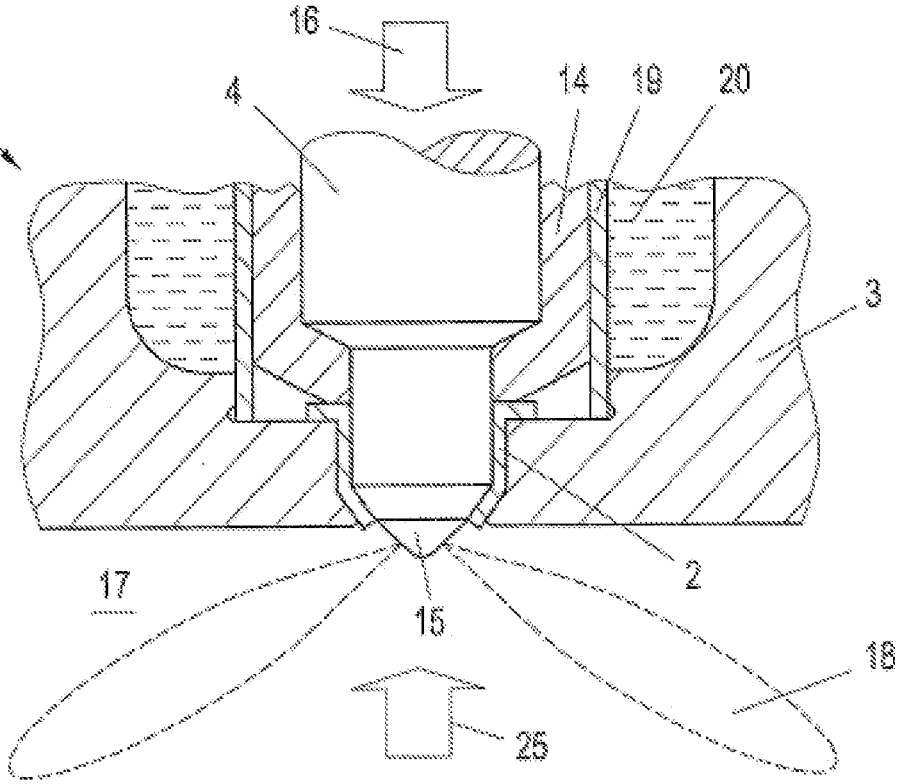
FIG. 1 shows a sectional illustration of a water-cooled cylinder head with injection nozzle and heat protection sleeve inserted therein.
Figure 2:
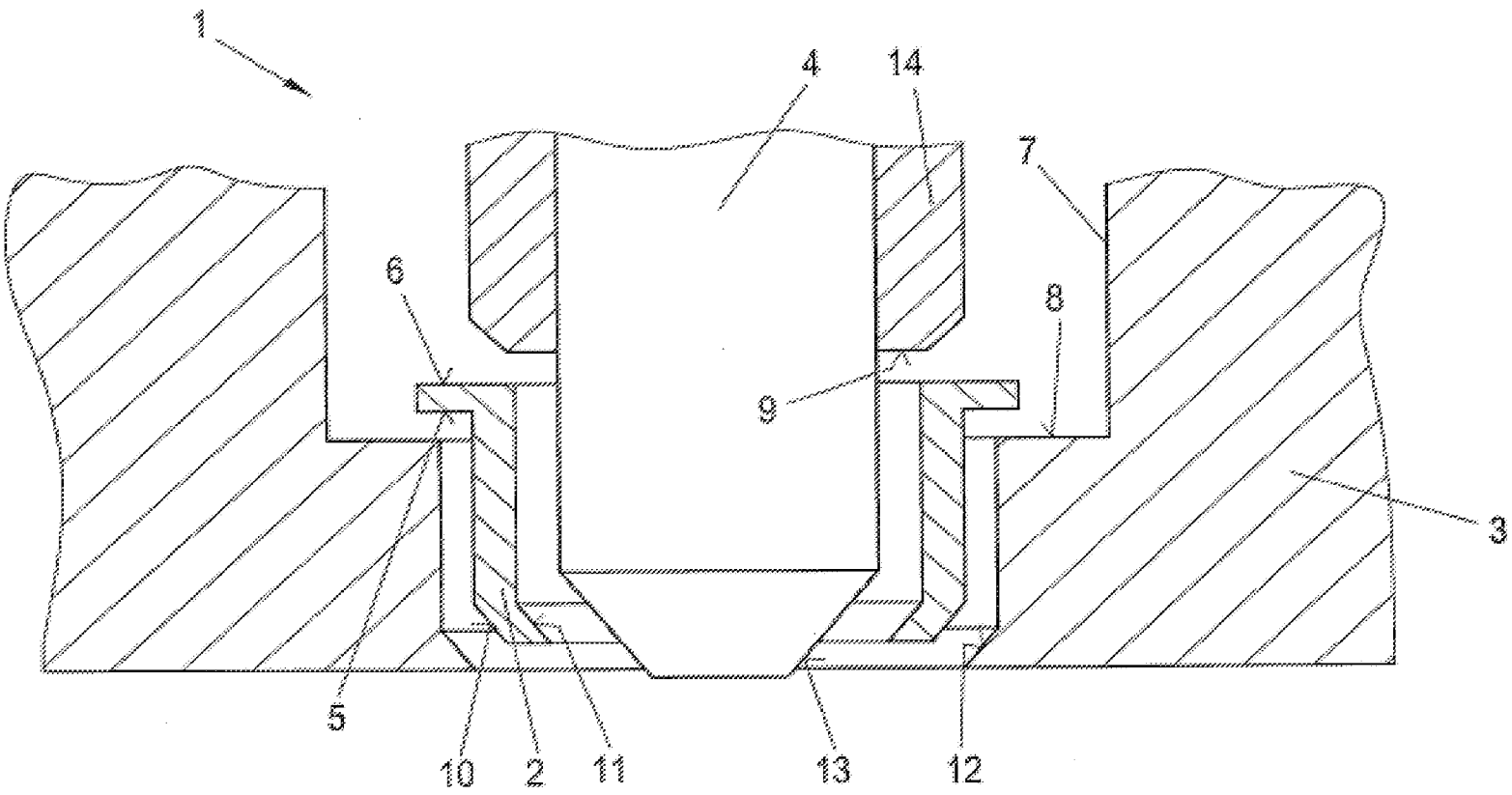
FIG. 2 shows an exploded illustration of the embodiment as per FIG. 1.

In FIG. 1, the injection nozzle according to the disclosure is denoted by 1, wherein a heat protection sleeve 2 is arranged between the cylinder head 3 and the nozzle body 4. As can also be seen from the detail illustration of FIG. 2, the heat protection sleeve 2 has, in a first sealing region, a first external sealing surface 5 and a first internal sealing surface 6. In the inserted state in the receiving bore 7 of the cylinder head 3, the first external sealing surface 5 interacts sealingly with an annular seat surface 8, which runs in a radial plane, of the receiving bore 7. The first internal sealing surface 6 interacts sealingly with an annular seat surface 9, which runs in a radial plane, of the nozzle clamping nut 14. In a second sealing region, the heat protection sleeve 2 furthermore has a second external sealing surface 10 and a second internal sealing surface 11. In the inserted state in the receiving bore 7 of the cylinder head 3, the second external sealing surface 10 interacts sealingly with a conical seat surface 12 of the receiving bore 7. The second internal sealing surface 11 interacts sealingly with a conical seat surface 13 of the nozzle body 4 or of the nozzle tip 15.

The first and second sealing surfaces form a double fit together with the corresponding seat surfaces of the receiving bore 7 and of the nozzle body 4. In the case of double fits, there is generally the problem that, depending on manufacturing tolerances, stresses of greater or lesser magnitude arise in the component in question, which stresses can change in the event of the slightest change in ambient conditions (for example thermal expansion), resulting in random and thus incalculable states. Owing to this indeterminacy in the case of double fits, the magnitude of the contact pressure for example in the second sealing region, for example at the nozzle tip, also cannot be controlled, resulting in the risk of leakage.

To eliminate the above-described problems caused by the double fit, the heat protection sleeve is preferably composed of a soft metal, in particular of a metal with a Mohs hardness of <4, such as for example copper or the alloys thereof, such that, during the insertion of the injection nozzle, the heat protection sleeve deforms and the component tolerances are thus compensated, and contact pressure is attained in particular in the second sealing region. The injector clamping force is in this case accommodated partially in the second sealing region and partially in the first sealing region. The combustion chamber pressure symbolized by the arrow 16 is more than compensated by the injector clamping force symbolized by the arrow 17, and the nozzle body 4 is thus held in the cylinder head 3. Owing to the design of the heat protection sleeve 2 according to the disclosure, the largest region of the nozzle tip 15 of the nozzle body 4 is protected against the heat of the combustion chamber 17. The injection jet of the injection nozzle 1 is schematically indicated by 18. A water sleeve 19 divides a water-filled cooling duct 20, which is arranged in the cylinder head 3, from the nozzle body 4.

Figure 3:
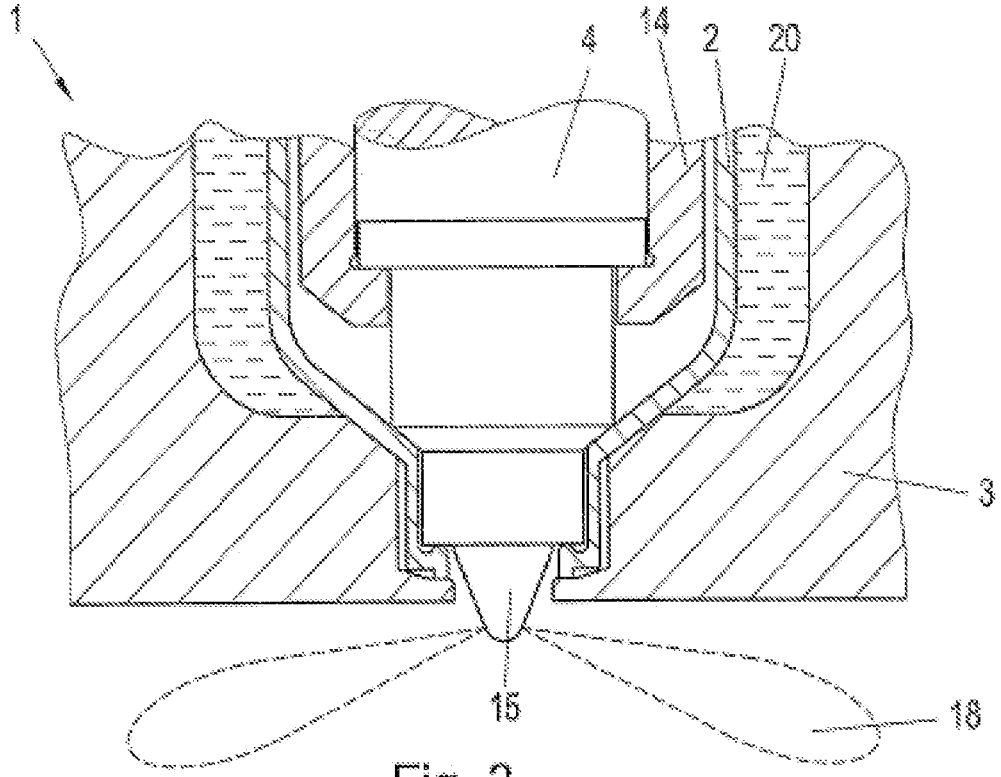
FIG. 3 shows an embodiment in which the heat protection sleeve is simultaneously the water sleeve.

In the illustration of FIG. 3, the heat protection sleeve 2 and the water protection sleeve are formed in one piece, whereby the water in the cooling duct 20 also cools the heat protection sleeve 2, whereby improved dissipation of heat from the nozzle tip is achieved.

Figure 4:
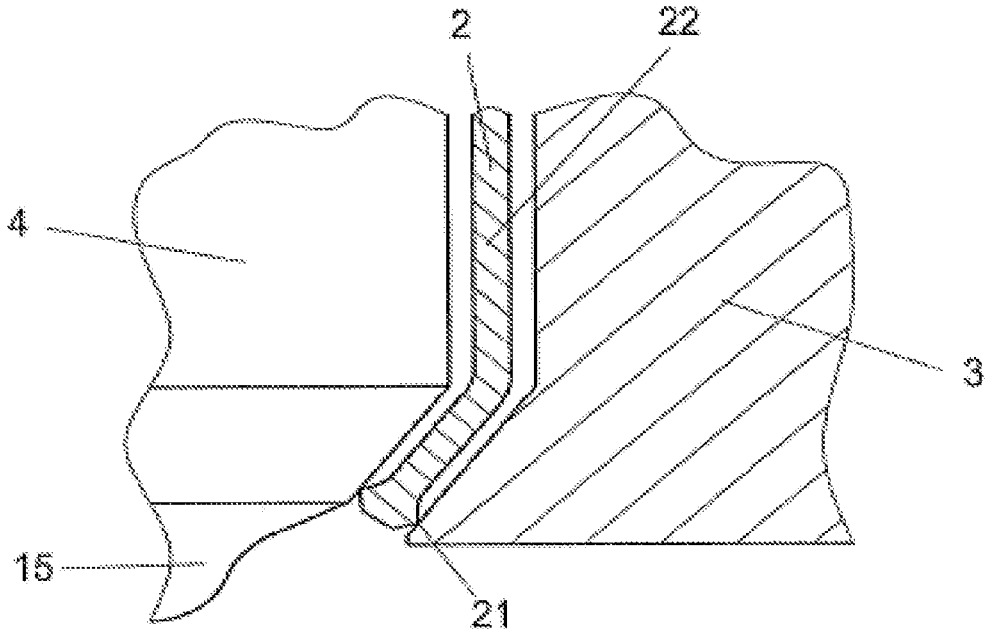
FIG. 4 shows a preferred embodiment of the heat protection sleeve with biting edges.

It can then be seen in FIG. 4 that the heat protection sleeve 2 that is arranged between the cylinder head 3 and injection nozzle 1 is, in its second sealing region, formed with an encircling edge that acts on the two parts 3 and 4 as a biting edge 21. This design leads to an improved sealing action. It can also be seen that the heat protection sleeve 2, in its cylindrical section 22 situated between the first sealing surfaces and the second sealing surfaces, is formed with a radial spacing to the nozzle body 4 and to the wall of the receiving bore 7 in the cylinder head 3.

Figure 5:
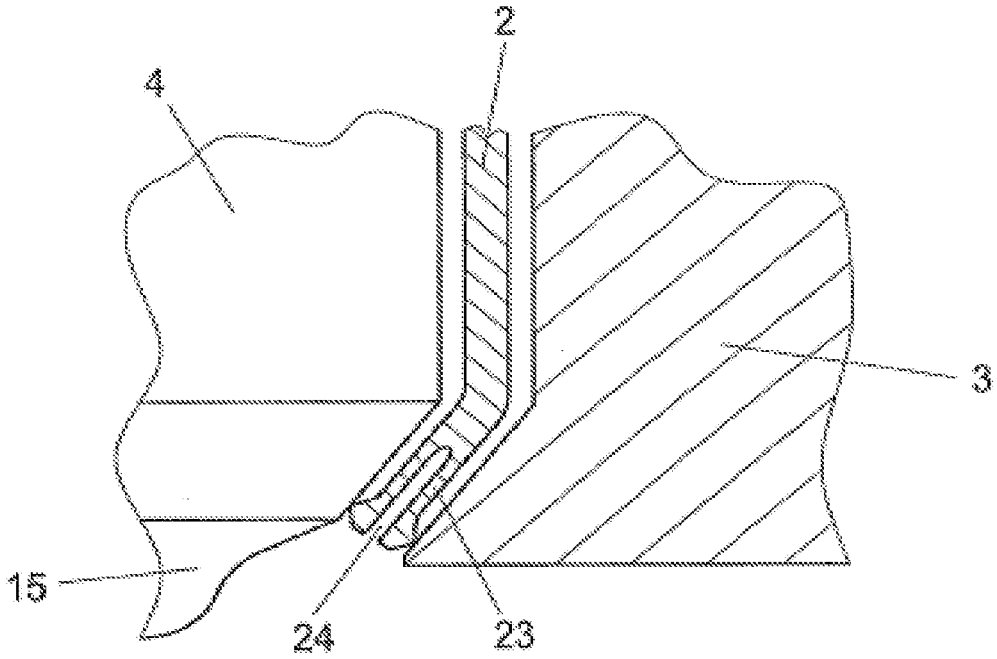
FIG. 5 shows a slotted embodiment of the heat protection sleeve.

FIG. 5 then illustrates a situation in which the end region 23 of the heat protection sleeve 2 is formed with a slot 24. In this case, when the heat protection sleeve 2 is subjected to combustion chamber pressure, this leads to the biting edges 21 being braced against the nozzle body 4 and against the cylinder head 3, whereby an improved sealing action is attained.

The invention claimed is:

1. An injection nozzle for injecting media into a combustion chamber, comprising:

a nozzle body that includes:

a nozzle tip having spray holes, and projecting into the combustion chamber; and a heat protection sleeve positioned in a combustion chamber-side end region of the nozzle body, wherein the heat protection sleeve surrounds the nozzle body, wherein the injection nozzle is configured to be inserted into a receiving bore of a holding part, wherein the combustion chamber-side end region of the nozzle body is configured to interact with the receiving bore via the heat protection sleeve, wherein the heat protection sleeve includes a first region and a second region which are axially spaced apart from each other, wherein the second region is located closer than the first region to the nozzle tip, wherein:

in the first region, a first external circumferential sealing surface is formed on an outer face of the heat protection sleeve and a first internal circumferential sealing surface is formed on an inner face of the heat protection sleeve, and in the second region, a second external circumferential sealing surface is formed on the outer face and a second internal circumferential sealing surface is formed on the inner face, wherein the second internal and external sealing surfaces are located at a portion of the heat protection sleeve having a smaller diameter than a diameter of a portion of the heat protection sleeve where the first internal and external sealing surfaces are located, wherein:

the first external sealing surface and the second external sealing surface interact in each case in sealing fashion with (i) an annular seat surface of the receiving bore that runs in a radial plane, or with (ii) a conical seat surface of the receiving bore, and the first internal sealing surface and the second internal sealing surface interact in each case in sealing fashion with (i) an annular seat surface of the nozzle body that runs in a radial plane, or with (ii) a conical seat surface of the nozzle body.

2. The injection nozzle as claimed in claim 1, wherein the first sealing surfaces and the second sealing surfaces form a double fit.

3. The injection nozzle as claimed in claim 1, wherein the heat protection sleeve is configured to be under preload when the injection nozzle is in inserted in the holding part.

4. The injection nozzle as claimed in claim 1, wherein the heat protection sleeve includes a deformable material, such that the first and second internal and external sealing surfaces are configured to interact with the annular or conical seat surfaces so as to generate a contact pressure when the first and second internal and external sealing surfaces are pressed against the annular or conical seat surfaces, such that a remaining clamping force of a nozzle clamping mechanism configured to clamp the injection nozzle in the holding part is accommodated at the first sealing surfaces and the corresponding annular or conical seat surfaces.

5. The injection nozzle as claimed in claim 1, wherein at least one of the annular or conical seat surfaces provided in the receiving bore is formed on a step of the receiving bore.

6. The injection nozzle as claimed in claim 1, wherein at least one of the annular or conical seat surfaces located on the nozzle body is formed on a nozzle clamping mechanism.

7. The injection nozzle as claimed in claim 1, wherein the second internal and external sealing surfaces are formed on the combustion chamber-side end of the heat protection sleeve.

8. The injection nozzle as claimed in claim 1, wherein the second internal and external sealing surfaces and the conical seat surfaces are configured to interact such that the combustion chamber-side seal of the nozzle body is produced in the receiving bore.

9. The injection nozzle as claimed in claim 1, wherein the heat protection sleeve, in an axial section between the first internal and external sealing surfaces and the second internal and external sealing surfaces, is positioned with a radial spacing to the nozzle body and to a wall of the receiving bore.

10. The injection nozzle as claimed in claim 1, wherein the heat protection sleeve includes a material with a thermal conductivity of greater than 100 W/(m·K).

11. The injection nozzle as claimed in claim 1, wherein the heat protection sleeve is formed integrally with a water sleeve which surrounds the nozzle body and which delimits a cooling duct, which is positioned in the holding part, with respect to the nozzle body.

12. The injection nozzle as claimed in claim 1, wherein the second internal and external sealing surfaces each have at least one projecting circumferential edge.

13. The injection nozzle as claimed in claim 1, wherein the heat protection sleeve has, between the internal and external second sealing surfaces, a circumferentially running groove or slot which is open toward the combustion chamber-side end.

* * * * *